United States Patent [19]

Shtanko et al.

[11] 3,944,714

[45] Mar. 16, 1976

[54] ELECTROSLAG REMELTING PLANT

[76] Inventors: Jury Pavlovich Shtanko, ulitsa E. Potie 9, kv. 92; Vitaly Mikhailovich Baglai, ulitsa Semashko 10, kv. 54/3; Boris Izrailevich Medovar, bulvar Lesi Ukrainki 2, kv. 8; Leonid Mikhailovich Stupak, Brest-Litovskoe shosse, 39, kv. 9; Georgy Anatolievich Pavliichuk, ulitsa Erevanskaya 8, kv. 8; Alexei Georgievich Bogachenko, ulitsa Miljutenko, 15/2, kv. 141, all of Kiev, U.S.S.R.

[22] Filed: Apr. 2, 1974

[21] Appl. No.: 457,184

Related U.S. Application Data

[63] Continuation of Ser. No. 353,670, April 23, 1973, abandoned.

[52] U.S. Cl. ..... 13/9 ES

[51] Int. Cl.[2] ..... H05B 3/60

[58] Field of Search ..... 13/9 ES, 9, 34

[56] References Cited

UNITED STATES PATENTS

| | | | |
|---|---|---|---|
| 3,619,464 | 11/1971 | Holzgruber | 13/9 ES |
| 3,622,678 | 11/1971 | Allen | 13/9 ES |
| 3,670,089 | 6/1972 | Paton et al. | 13/9 ES |
| 3,768,998 | 10/1973 | Yonemochi | 13/9 ES |

*Primary Examiner*—R. N. Envall, Jr.
*Attorney, Agent, or Firm*—Holman & Stern

[57] ABSTRACT

An electroslag remelting plant comprises a cooled mould, a base plate adapted for shaping the bottom part of an ingot, a single-phase transformer having a secondary winding with a midpoint, and two similar groups of electrodes, each one of the two groups of electrodes comprises at least two electrodes and being connected to one of the ends of the secondary winding of the single-phase transformer so that each two proximate adjacent electrodes have an opposite polarity.

10 Claims, 8 Drawing Figures

ELECTROSLAG REMELTING PLANT

This is a continuation of application Ser. No. 353,670, filed Apr. 23, 1973 now abandoned.

BACKGROUND OF THE INVENTION

The present invention relates generally to electrometallurgy and more particularly, it relates to electroslag remelting plants.

The invention may prove to be most advantageous for melting ingots by remelting a plurality of electrodes at one and the same time, with the number of the electrodes exceeding four and being divisible by two.

There are known in the art electroslag remelting installations wherein four and more electrodes coupled to a singlephase transformer are remelted at one and the same time. In order to achieve high performance characteristics of the remelting process, reduce power input per ton of the remelted metal and decrease the capacity of the single-phase transformer feeding the furnace, the electrodes are connected in series to the secondary winding of the above transformer. Half of the electrodes (one group) is connected to one end of the secondary winding of the transformer, the other half (another group) being connected to another end.

In the known plants, the electrodes in each group are disposed in a single row, side by side, with the electrode groups facing each other.

In melting in such installations an alternating current is made to pass nearer to the surface of the electrodes turned to the electrodes of an opposite polarity, i.e. internal surfaces of the electrodes facing the oppositepolarity electrodes are heated to a higher temperature than their external surfaces. Thus, in remelting the electrodes in magnetic steel, 200 mm thick, a drop in temperature along the electrode sections may reach 200°C. With such a large temperature gradient the electrodes are liable to warp and a hazard may take place that the electrodes will touch a mould wall and, hence, burn it through. It is for this reason that in the above plants in order to exclude contact between the electrodes and the mould wall either the mould cross section is increased or the electrode section is reduced with a simultaneous enlargement of the electrode length and, hence, of the plant height. In these cases heat losses as well as power input per ton of the remelted metal are increased. Moreover, due to substantial heating of the electrode surfaces, the metal of the electrode surfaces is oxidized with the products of oxidation getting into slag and impairing the degree of refinement of the metal. When remelting the electrodes subject prior to the remelting operation to warping, which may always happen in practice, the electrodes of unlike polarity may be spaced out at different distances. In this case the electrodes placed on smaller spacing will upon melting be immersed in a slag bath to a smaller depth and those on larger spacings will be immersed in the slag bath to a larger depth during melting. The foregoing results in the formation of defects on the surface of the ingot obtained and adversely affects quality of metal.

SUMMARY OF THE INVENTION

The main object of the present invention is to provide a plant for the electroslag remelting of two groups of electrodes which, in comparison with the known plants of the same type will ensure a more uniform and lower heating of the electrodes along their longitudinal sections.

Another object of the invention is to provide a plant for electroslag remelting which will reduce warping of the electrodes along their length in the course of melting.

Still another object of the invention is the provision of an electroslag remelting plant which will decrease susceptibility of the electrode metal to oxidation during the melting process.

These and other objects are achieved by the provision of a plant for the electroslag remelting in a cooled mould of two similar groups of electrodes, each of which comprises at least two electrodes and is connected to one end of the secondary winding of a single-phase transformer with a winding midpoint being electrically associated with a base plate and the mould, wherein, according to the invention, two proximate adjacent electrodes have an opposite polarity.

In the herein-proposed plant the proximate adjacent electrodes may be spaced out at equal distances. It is most expedient that the distance be equal to 0.1–2.0 of the electrode thickness. With the distance smaller than 0.1 of the electrode thickness, the electrode may melt off on the surface of the slag bath with the ensuing intense oxidation of the electrode.

With the electrode spacing exceeding twice the electrode thickness, defects may form on the surface of the ingot in the spacing between the peripheral electrodes and in the macrostructure of the ingot.

When carrying out remelting in the plant according to the invention the electric current is distributed along the electrode section more uniformly and the electrode surfaces turned to the adjacent electrodes will be heated to a lesser degree, maximum density of the current on the above surfaces being less than that obtainable in the known plants of the same type.

The herein-proposed plant may incorporate the molten slag start, i.e., remelting may be commenced by both pouring the molten slag into the mould or melting it in the mould with the help of consumable or nonconsumable electrodes introduced into the mould.

It is expedient that the slag be poured into the bottom part of the mould by making use of a bottom-pour device made in such a manner that a port for introducing the slag into the mould is located near the mould wall between the two proximate electrodes. With the port disposed between the electrodes, the slag contacts simultaneously two electrodes of the opposite polarity ensuring thereby accurate location of the slag level in the mould.

Further with the above arrangement of the port adapted for introducing the slag, to reduce metal rejects in the form of bottom scrap the melting process may be started with the slag heated to high temperatures without entrapping the metal into the port. The metal which happens to get into the port interferes with the further operation with the ingot (handling, forging or rolling) and this involves additional expenditures on cutting the metal from the ingot after melting.

In melting ingots of a rectangular cross section with the electrodes in both groups being arranged in a single row, the port for introducing the slag into the mould is disposed between the two proximate adjacent electrodes arranged in the central zone of the mould.

When melting the slag in the plant mould with the aid of the consumable electrodes a conventional dummy bar — a metallic plate — may be used to protect the base plate from the effect of electric arcs striken in melting the slag. The dummy bar may be mounted on the base plate under the two adjacent electrodes of different groups with the electric arcs, which melt the slag, being striken in succession between the electrodes and the steel plate mounted on the base plate.

In such a manner a restricted flux melting area is created near the two electrodes with the area progressively enlarged throughout the entire cross section of the mould and with the remaining electrodes being gradually introduced into the slag bath. To reduce an ingot building-up rate and to conduct melting with a shallow metal bath, the mould with the base plate or an electrode holder with the electrodes may be made to allow their transfer in a horizontal plant at a distance not less than the spacing between the center points of the cross section of the two adjacent electrodes.

This horizontal transfer may be rectilinear or circular in melting annular ingots both with a solid section or hollow ones.

To increase productivity of the remelting process in the herein-proposed plant use may be made of the so-called dead blanks mounted between the live electrodes of unlike polarity and insulated from the plant.

It is expedient that the total weight of the dead blanks amounts to 10–50% of that of the ingot being built-up so that the larger the ingot weight and electrode section, the greater may be the weight percentage of the dead blanks of the ingot weight.

The distance between the dead blanks and electrodes is determined by blank thickness, amounting to 0.1–1 of the blank thickness.

In order to enable the production of the long ingots which requires the adjustment of the rate of cooling of the bottom part of the ingot during melting, as well as for obtaining hollow ingots and concurrent melting of several ingots with a solid cross section, the mould and base plate are allowed to traverse vertically relative to each other.

In order to keep the level of the metal bath at a preset height in the movable mould, it is expedient that the plant be fitted with a metal bath level gauge built into the mould wall so that its working end face is located opposite to one of the consumable electrodes by virtue of which a layer of slag on the gauge end face may be thinner than on the ingot.

For maintaining the level of the metal bath at a preset height relative to the movable mould, it is expedient that the plant be furnished with a metal bath level gauge built into the mould wall so that the gauge working end face is positioned between the two adjacent electrodes. In this case the probability of passage of the electric current through the gauge is practically excluded.

Usually the ingots, on being melted, remain in the mould, practically until the slag is completely hardened.

To reduce the ingot holding time in the mould, the plant is equipped with a device for tapping slag from the mould.

It is expedient that the slag hole be located in a spacing between the two proximate electrodes. This affords the possibility of tapping the slag with the electrodes accommodated in the mould.

Depending on the ingot section, the slag hole may be spaced some 20–200 mm apart from the metal level in the mould at the end of the melting process.

BRIEF DESCRIPTION OF THE DRAWINGS

The present invention will be better understood from a consideration of a detailed description of exemplary embodiments thereof, when read in conjunction with the accompanying drawings wherein.

DETAILED DESCRIPTION OF THE PREFERRED EMBODIMENT

Figure 1:
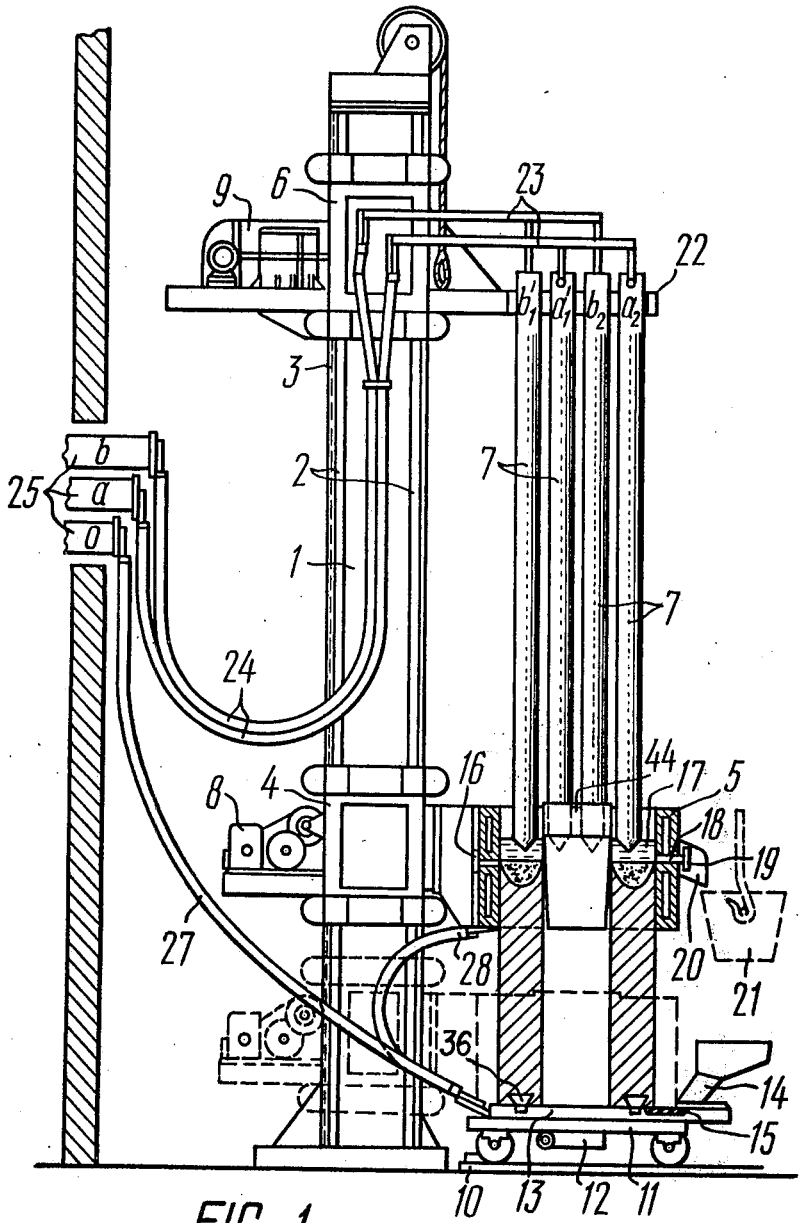
FIG. 1 is a general view of the plant, according to the invention, in melting a hollow ingot with the mould section along a vertical plane.

Referring now to FIG. 1, a plant comprises a hollow metallic mast 1 incorporating counterweights (not shown in FIG. 1). The mast may be square, rectangular or round in cross section. The mast is fitted with guide rods 2 and a toothed rack 3 fastened to the mast. The mast 1 mounts a trolley 4 adapted for securing a mould 5 and a trolley 6 for electrodes 7. The trolley 4 traverses along the mast 1 with the help of a drive 8, the trolley 6 being traversed along the mast 1 by a drive 9. Both trolleys move along the guide rods 2 through the use of the toothed rack 3 which is engaged with pinions of the drives 8 and 9. Near the mast of the herein-proposed plant runs a railroad track 10 along which travles a trolley 11 with a drive 12. The trolley 11 mounts a base plate 13 adapted for securing to it a device 14 for pouring slag into the bottom part of the mould 5 which at the initial stage of the melting process is installed on the base plate 13, as shown in FIG. 1 by dotted lines. The external surface of the base plate 13 is provided with a recess 15 through which the space of the slag-pouring device 14 communicates with that of the mould 5 when the slag is poured through the device 14. The device 14 is so made that it can be detached from the base plate 13. The base plate 13 is cooled with water (the water inlet for cooling the base plate and mould is not shown in the drawing).

The recess 15 is arranged in the base plate 13 opposite to the spacing between the electrodes 7. Built in the wall of the mould 5 is a level gauge 16 indicating the level of liquid metal 17. Above the gauge 16 in the opposite wall of the mould 5 there is a hole 18 closed during remelting with an uncooled copper or graphite plug 19. Near the hole 18 from the mould wall runs a trough 20 adapted for tapping the slag into a container 21, with the process being effected after the plug 19 has been drawn out of the hole 18 at the end of the melting operation (the container 21 is shown by a dotted line). The consumable electrodes 7 are made fast in an electrode holder 22, being insulated from one another and subdivided into two similar groups *a* and *b*.

Figure 2:
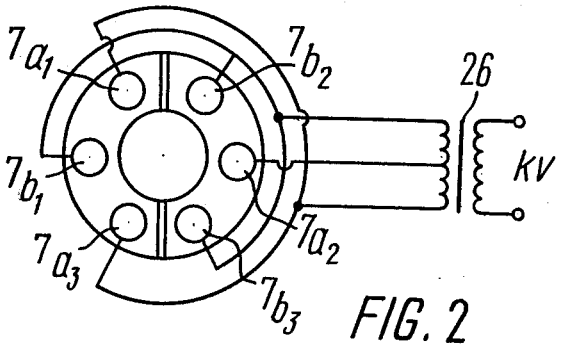
FIG. 2 shows a layout of the electrodes in the mould in melting a hollow ingot and a schematic illustrating their connection to the secondary winding of the transformer.

In accordance with the invention, the electrodes $7a_1$, $7a_2$, $7a_3$ (FIG. 2) of the group *7a* are so arranged in relation to the electrodes $7b_1$, $7b_2$, $7b_3$ of the group *b* that each two proximate adjacent electrodes are of an opposite polarity.

An electric current is passed to the electrode holder 22 (FIG. 1) along copper cooled pipes 23 fastened to the trolley 6. Connected to the ends of these pipes are water-colled flexible cables 24 which, in turn, are coupled to bus bars 25*a* and 25*b*. The latter are connected each to one of the ends of the secondary winding of an A.C. single-phase transformer 26. The bus bar 25*o* is coupled by a flexible cable (wire) 27 (FIG. 1) from one side to the leadout of a midpoint of the secondary winding of the above transformer and from the other side to the base plate 13. The latter is, in turn, connected to the mould 5 with the help of a flexible cable (wire) 28. Thus, the midpoint (zero point) of the secondary winding is electrically associated with both the base plate and the mould.

The spacings on which the electrodes are placed in the electrode holder are equal to each other, amounting, depending on the weight and steel grade, to 0.1–2.0 of the electrode thickness.

A slight mismatch between the electrode spacings is quite possible, insofar as in practice the consumable electrodes for industrial use always feature a certain degree of warping.

Figure 3:
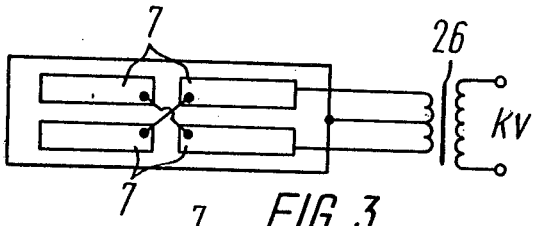
FIG. 3 is a layout of the electrodes in the mould in melting a rectangular ingot with a solid section and a schematic showing their connection to the secondary winding of the transformer.
Figure 4:
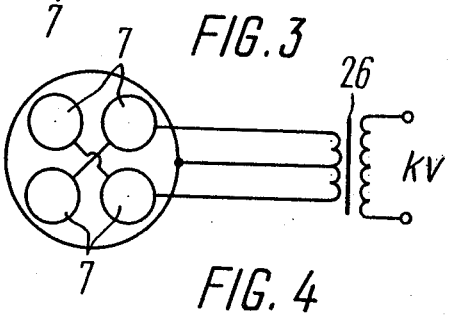
FIG. 4 is a layout of four electrodes having a round section in the mould also featuring a round section.

In melting ingots having a rectangular cross section by remelting the rectangular electrodes 7, the electrodes are arranged as shown in FIG. 3, in pairs with their wide sides facing one another.

Where an ingot of a circular, as it is represented in FIG. 4, or square cross section is to be melted, it is expedient that the four electrodes 7, circular of square in cross section, be used with the winding of the transformer 26 being connected as shown in FIG. 4.

Figure 5:
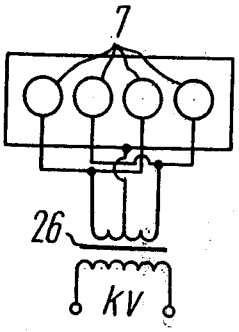
FIG. 5 is a layout of the electrodes in a single row in melting a narrow rectangular ingot and a schematic illustrating their connection to the transformer secondary winding.

In producing a rectangular ingot by remelting the electrodes 7 having a circular or square cross section, they are located in a row and connected to the transformer as shown in FIG. 5.

Figure 6:
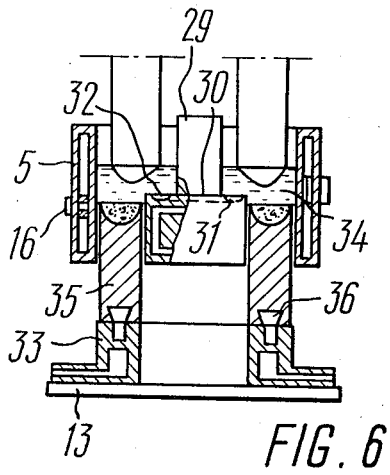
FIG. 6 is a longitudinal sectional view of the mould for melting hollow ingots.

In case of the electrode diameter equalling or exceeding the wall thickness of a hollow ingot, an internal mould 29 (FIG. 6) fastened to the external mould 5 is narrowed in its top portion. It is expedient that the surface 30 connecting the top and bottom portions be fitted with an annular slot 31 to be filled with molten metal 32 during remelting.

The base plate 13 mounts a cooled collar 33 which in the initial period of the melting process enters a clearance between the external mould 5 and the bottom portion of the internal mould 29. The height of the collar 33 is chosen so that before the mould 5 commences to move upwards by a signal received from the level gauge 16, a layer of metal 20–60 mm thick has been hardened on the collar 33 in a space 34 adapted to shape the ingot 35.

Figure 7:
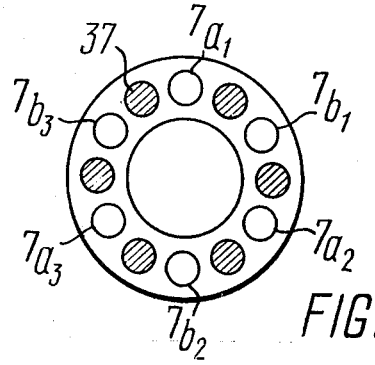
FIG. 7 is a layout of dead blanks in the mould for melting a hollow ingot.

The collar 33 may be used for mounting and attaching by any suitable means dummy bars 36 adapted for holding the ingot in place and feeding current to it. In the plant shown in FIG. 7 the spacings between the electrodes 7 of unlike polarity (*a* and *b*) may accommodate dead blanks 37 fixed in relation to the electrodes and insulated from them, with the blank weight ranging from 10 to 50% of that of the ingot being built-up.

Figure 8:
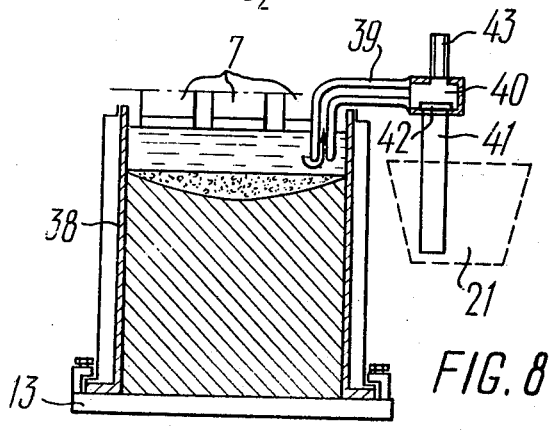
FIG. 8 depicts a longitudinal sectional view of a mould with an ingot at the end of the melting process and with a device for drawing off the slag.

In place of the mould 5 which is capable of revolving relative to the base plate 13, the plant may comprise a mould 38 fastened to the base plate 13 (FIG. 8). To lift such a mould from the ingot use may be made of the trolley 4, if furnished with brackets which are attached to it (not shown in the drawings).

The mould 38 is preferably used for producing short ingots of a large cross section. In order to reduce the depth of the metal bath in melting such ingots, the base plate 13 in conjunction with the mould 38 may reciprocate with the help of the trolley 11 and drive 12.

For tapping the slag from the mould 38, as in the case of the mould 5, use is made of a slag tapping device comprising a pipe 39 adapted for drawing off the slag by being introduced into the slag in the spacing between the two electrodes. The pipe 39 may be either cooled or lined with a refractory material chemically stable and resistant against erosion by slag, such as graphite.

To enable slagging with the help of some transporation gear or a crane, the above device is traversed so that the end of the pipe 39 is immersed in the slag between the electrodes. Depending on the ingot cross section a clearance between the end of the pipe 39 and the metal (liquid metal) ranges from 20 to 200 mm. The larger the ingot section and the depth of the slag bath, the greater is the clearance. For an ingot 1500 mm in diameter, the pipe 39 may be mounted at a distance of 80–100 mm from the liquid metal. In this case, the remaining layer of the slag 80–100 mm thick will be sufficient to warm the top portion of the ingot and of the metal bath and to protect the metal against oxidation. Such a layer of slag will harden practically simultaneously with the last batches of metal and will not delay the withdrawal of the ingot.

Upon introducing the pipe 39, a device adapted to eject air from a chamber 40 is cut in with the chamber being closed on the side of a connecting pipe 41 with a fusible end cap 42 of a membrane type.

The liquid slag is drawn off into the chamber 40, fuses the end cap 42 and flows down into the container 21. Further slagging is effected by gravity, insofar as a passage 43 for drawing off air is plugged with hardened slag.

The plant shown in FIG. 1 is also suitable for melting ingots with the slag bath being established in the mould by means of consumable or nonconsumable electrodes which, upon establishing the slag bath, are removed from the electrode holder and replaced by the consumable electrodes introduced into the slag bath.

Let us consider the operation of the disclosed herein plant by analysing an illustrative example, i.e. melting a hollow ingot by using the molten slag start. The base plate 13 mounts the metallic dummy bars 36 or a single annular dummy bar adapted to hold the ingot on the base plate and to provide contact between the ingot and the base plate, with the dummy bars being fastened by any known method uniformly along the perimeter of the ingot.

Following that the trolley 4 with the mould 5 and accommodated in it level gauge 16 are descended with the plug 19 turned down in such a manner that the mould bottom surface will touch that of the base plate 13. Then the electrodes 7 are installed in the electrode holder 22 so that their lower ends are spaced apart from the base plate 13 at a distance approximately equal to a requisite depth of the slag bath. After that, the device 14 for pouring slag into the bottom portion of the mould 5 along the recess 15 is set up on the base plate 13. Then, the transformer 26 is energized and a requisite amount of the slag is poured into the mould 5. The moment of completion of the pouring operation may be determined by the passage of an electric current through the electrodes 7. Upon building up the ingot to the level gauge 16, the mould is transferred upward by a signal from the level gauge with a speed equal to the ingot building-up rate. After the molten slag start, the electrodes 7 are lowered as they melt off.

An upward motion of the mould may be performed either continuously or intermittently. The current magnitude and the voltage are maintained so that the requisite ingot building-up rate is ensured.

Upon melting the ingot of a requisite hiehgt, it is allowed to shrink by changing the current and voltage of the transformer 26, whereupon the transformer is de-energized and the plug 19 driven out of the hole 18 by any suitable method. Slag is tapped through the hole 18 into the container 21. At the same time the mould 5 is moved upward, otherwise the internal mould 44 can be caught by the ingot through to its shrinkage.

When slagging is completed, the mould 5 is lifted above the solidified ingot, whereupon the base plate 13 with the ingot is rolled out from under the electrode holder 22 with the help of the drive 12.

Upon detaching the dummy bar 36, the ingot is removed from the base plate 13. Electrode stubs or inventory parts intended for reuse, if any, are also stripped from the electrode holder 22. The recess 15, and if necessary the device 14, are cleaned from hardened slag. A new dummy bar is made fast and the next hollow ingot is melted by following the above-described sequence of operations.

What we claim is:

1. An electroslag remelting plant comprising: a cooled mould; a base plate adapted for shaping the bottom part of an ingot; a means having a hole arranged near the mould wall for bottom pouring of molten slag into the bottom part of the mould; a means having a hole for tapping molten slag from the mould accommodated in the top portion of the mould; a means mounted in the mould wall for detecting the level of molten metal in the mould; a single-phase transformer having a secondary winding with a midpoint electrically connected to the base plate and the mould; two similar groups of electrodes; each one of the two groups of the electrodes comprising at least two electrodes disposed in the mould and connected to one of the ends of the secondary winding of the single phase transformer so that each two proximate adjacent electrodes have an opposite polarity; a means for holding the electrodes immovable relative to each other over the mould and for supplying electric current to the electrodes; a means for moving the means for holding the electrodes in a vertical and a horizontal direction; a means for moving the mould in a vertical and a horizontal direction; and a means for moving the base plate in a horizontal direction.

2. The plant as claimed in claim 1 wherein the electrodes are arranged along the perimeter of the cross section of the mould.

3. The plant as claimed as claim 1 wherein the electrodes are arranged in the central zone of the cross section of the mould.

4. The plant as claimed in claim 1 wherein the spacings between the proximate adjacent electrodes are equal to each other and are within the range from 0.1 to 2.0 electrode thicknesses.

5. The plant as claimed in claim 1 wherein the electrode holder and the mould with the base plate are made to allow their reciprocating motion in a horizontal direction at a distance not less than that between the centers of the adjacent electrodes.

6. The plant as claimed in claim 1 wherein the hole of the means for pouring slag into the mould is arran ged opposite the spacing between two electrodes of opposite polarity.

7. The plant as claimed in claim 1 wherein the means for detecting the level of molten metal in the mould has its working element arranged opposite the spacing between two proximate adjacent electrodes.

8. The plant as claimed in claim 1 wherein the tapping hole of the slag tapping means is arranged between two adjacent electrodes at a distance of 20 to 200 mm above the level of metal at the end of melting and made in the mould wall.

9. The plant as claimed in claim 1 wherein the means for tapping the slag from the mould comprises a pipe adapted for drawing off the slag, said pipe being introduced into the slag between the two adjacent electrodes.

10. The plant as claimed in claim 9 wherein the pipe introduced into the slag for drawing it off is provided with a cooling means.

* * * * *